US006695372B2

(12) United States Patent
Parker

(10) Patent No.: US 6,695,372 B2
(45) Date of Patent: Feb. 24, 2004

(54) LOCKING CLAMPING MEANS

(75) Inventor: Ronald Leslie Parker, 77 Lichfield Road, Putaruru (NZ)

(73) Assignee: Ronald Leslie Parker, Putaruru (NZ)

( * ) Notice: Subject to any disclaimer, the term of this patent is extended or adjusted under 35 U.S.C. 154(b) by 0 days.

(21) Appl. No.: 10/104,010

(22) Filed: Mar. 25, 2002

(65) Prior Publication Data

US 2003/0178865 A1 Sep. 25, 2003

(51) Int. Cl.[7] ..... B66C 1/42; B66C 1/44

(52) U.S. Cl. ..... 294/110.1; 294/110.2; 294/118

(58) Field of Search ..... 294/107, 110.1, 294/110.2, 118; 414/624, 625, 626

(56) References Cited

U.S. PATENT DOCUMENTS

| | | | | | |
|---|---|---|---|---|---|
| 2,100,800 | A | * | 11/1937 | Ferris | 294/107 |
| 2,656,212 | A | * | 10/1953 | Eckstein | 294/110.1 |
| 2,776,164 | A | * | 1/1957 | Eckstein | 294/110.1 |
| 2,815,242 | A | * | 12/1957 | Kenyon | 294/110.1 |
| 2,893,778 | A | * | 7/1959 | Eckstein | 294/110.1 |
| 3,317,235 | A | * | 5/1967 | Botten | 294/118 |
| 4,030,625 | A | * | 6/1977 | Koehnen | 294/118 |
| 4,637,645 | A | | 1/1987 | Eriksson | |
| 5,797,639 | A | * | 8/1998 | Zorzenon | 294/110.1 |
| 6,257,636 | B1 | | 7/2001 | Hovis | |

FOREIGN PATENT DOCUMENTS

| | | | | |
|---|---|---|---|---|
| DE | 206391 | * | 2/1902 | 294/118 |
| GB | 1224694 | * | 3/1971 | 294/110.2 |
| SU | 1477652 | * | 5/1989 | 294/110.2 |

* cited by examiner

*Primary Examiner*—Eileen D. Lillis
*Assistant Examiner*—Paul T. Chin
(74) *Attorney, Agent, or Firm*—Bio Intellectual Property Services (BioIps)

(57) ABSTRACT

A grapple 1 comprises a sleeve 8 moveable along a shaft 12. The sleeve 7 is joined to an upper attachment 6 for receiving the long-line of a crane, and the shaft 12 is joined to a pivot attachment 13. The sleeve 7 and the pivot attachment 13 are joined to jaws 2 and 3 which can move in a scissor-like fashion. Pushing down on the sleeve 7 causes a rider 9, forming part of a catch rod 8, to move into a series of stepped channels in a block 14 associated with the shaft 12. The rider 9 can be positioned in the channels to lock the jaws 2 and 3 open, and can be subsequently removed from the channels to enable the jaws 2 and 3 to close towards one another.

5 Claims, 2 Drawing Sheets

LOCKING CLAMPING MEANS

FIELD OF INVENTION

This invention relates to a locking means for a clamp.

BACKGROUND OF INVENTION

It is known to use clamping devices, for example, grapples, to hold a load while it is lifted and carried from one place to another with the assistance of an overhead cable or the like. The cable may or may not form part of a crane, gantry, etc. It is desirable to have a simple locking arrangement which enables the jaws of the clamp to be held in a desired disposition, at least momentarily, while the clamp is in use. It is, accordingly, an object of the present invention to go at least some ways towards achieving this, or to at least provide the public with a useful choice.

The term "comprise", "comprises", "comprised", or "comprising", if and when used herein, should be interpreted non-exclusively—ie to convey "consisting of or including".

SUMMARY OF THE INVENTION

According to one aspect of the invention, there is provided locking means, the locking means comprising a catch portion and a guide portion, the catch portion and the guide portion being capable of movement with respect to one another, the catch portion having a rider, and the guide portion having a pathway for guiding the rider;

the locking means forming part of or being associated with clamping means, wherein the clamping means has a first jaw and a second jaw, the locking means being arranged such that the catch portion can move in a first direction with respect to the guide portion such that the rider moves along the pathway until it reaches a stepped portion of the pathway, the arrangement being such that when the rider is in a certain position in the stepped portion the jaws are unable to close with respect to one another, and wherein the rider can then be moved from the stepped portion and in a second direction to enable the jaws to close with respect to one another.

Preferably, the first and second directions are substantially opposite with respect to one another.

Preferably, the guide portion includes a block, and the pathway comprises a series of channels within the block, each channel being at a different level.

Preferably, each channel is separated from the other channels.

Preferably, the series of channels comprises a first channel, a second channel angled away from the first channel, a third channel angled away from the second channel, and a fourth channel angled away from the third channel; the channels being such that the rider can move along the first channel, then into the second channel, then into the third channel, and then into the fourth channel.

Preferably, the second and third channels together form the stepped portion.

Preferably the rider forms part of a spring tensioned rod, for example a small part of the rod turned at an angle (eg a right angle) with respect to the rest of the rod.

Preferably, the catch portion includes a sleeve which can move around the guide portion.

Preferably, the catch portion is connected to the jaws by way of lengths of chain or cord.

Preferably, the jaws can pivot with respect to the guide portion.

According to a further aspect of the invention, there is provided a clamp, comprising a sleeve, a shaft, a pair of jaws, a rod, a long line attachment, a first channel, a second channel, a third channel, and a fourth channel;

a first end of the sleeve being combined with the long line attachment, and a second end of the sleeve receiving the shaft, the sleeve being moveable longitudinally around the shaft, the rod having an angled rider part arranged such that when the sleeve is moved downwards on the shaft the rider can be received in and move along the first channel, and then at an angle to the first channel into the second channel, and then to the third channels and will remain at a locked position in the third channel until forcibly moved along the third channel, and then at an angle into the fourth channel to unlock the jaws so that they can move towards one another in a clamping action. Optionally, the rod is spring tensioned. Optionally, the second and third channels are angled with respect to one another. Optionally, the first, second, third, and fourth channels are in a block associated with the shaft, and each channel is at a different level in the block.

DESCRIPTION OF THE DRAWINGS

Some preferred forms of the invention will know be described by way of example, and with reference to the accompanying drawings, of which.

DETAILED DESCRIPTION OF THE INVENTION

Figure 1:
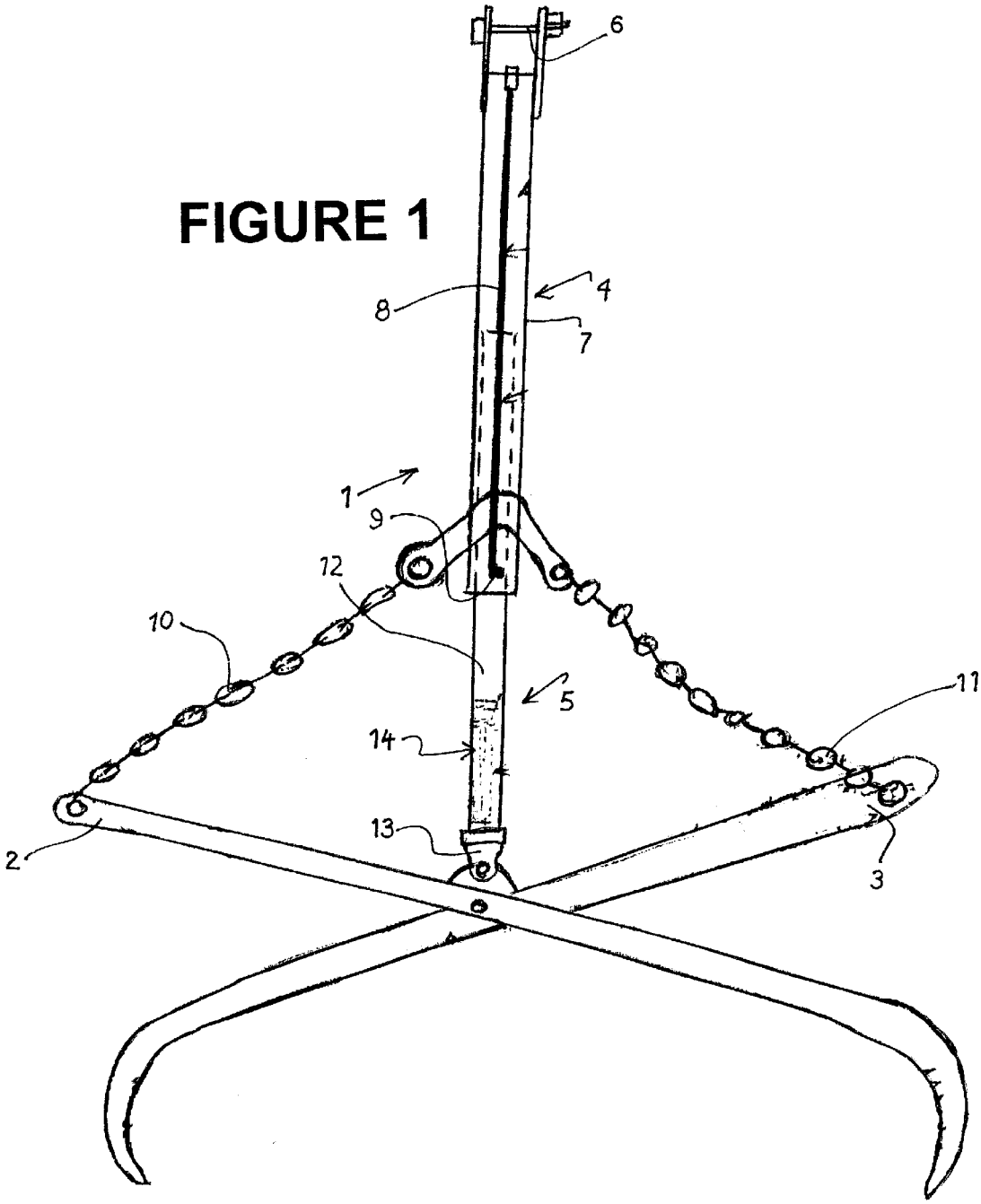
FIG. 1 is a schematic view of a grapple for use in carrying loads.
Figure 2:
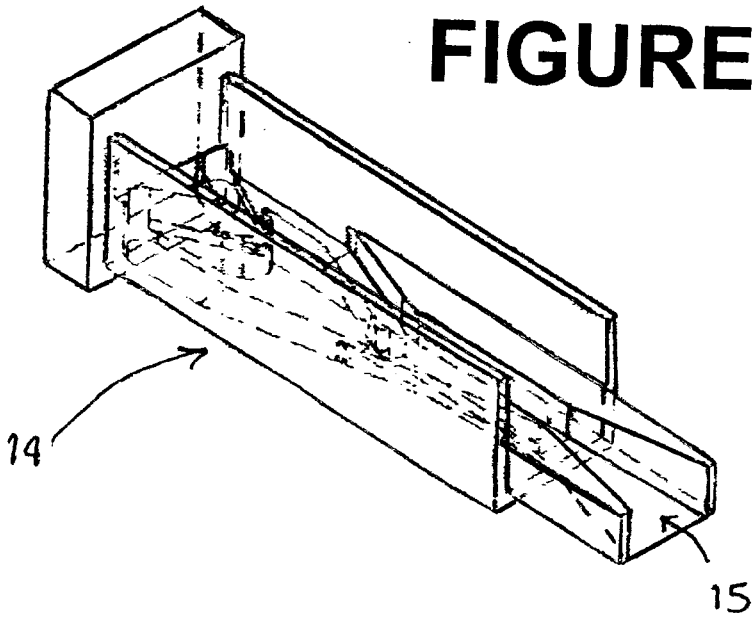
FIG. 2 is a perspective view showing part of a locking means forming part of the grapple.

Referring to FIG. 1, the invention includes a grapple 1 having jaws 2 and 3 which can be set by way of "locking means". The locking means forms part of the grapple 1, and includes a catch portion 4 and a guide portion 5.

The catch portion 4 includes an attachment 6 for receiving an overhead long line chain or cord from a crane or the like. The catch portion 4 also includes a tube like sleeve 7 secured to and proceeding downwards from the attachment 6. The sleeve 7 may or may not be closed at its upper end. As shown in FIG. 1, a spring tensioned steel catch rod 8 is within the sleeve 7, the arrangement being such that the upper end of the catch rod is fixed. The lower end of the catch rod 8 is free within the sleeve 7. As also shown in FIG. 1, the lower end of the catch rod 8 has a rider 9 formed as a small right angle turn in the catch rod. FIG. 1 also shows that the catch portion 4 is connected to upper parts of the jaws 2 and 3 by way of short lengths of chain 10 and 11.

With further reference to FIG. 1, the guide portion 5 includes a square section hollow shaft 12 which can be moved longitudinally within the sleeve 7 so that it is covered by the sleeve to a greater or lessor extent. The guide portion 5 also includes a lower pivot attachment 13 secured to medial parts of the jaws 2 and 3, so that the jaws can move in scissor-like fashion about the pivot attachment 13.

Figure 3:
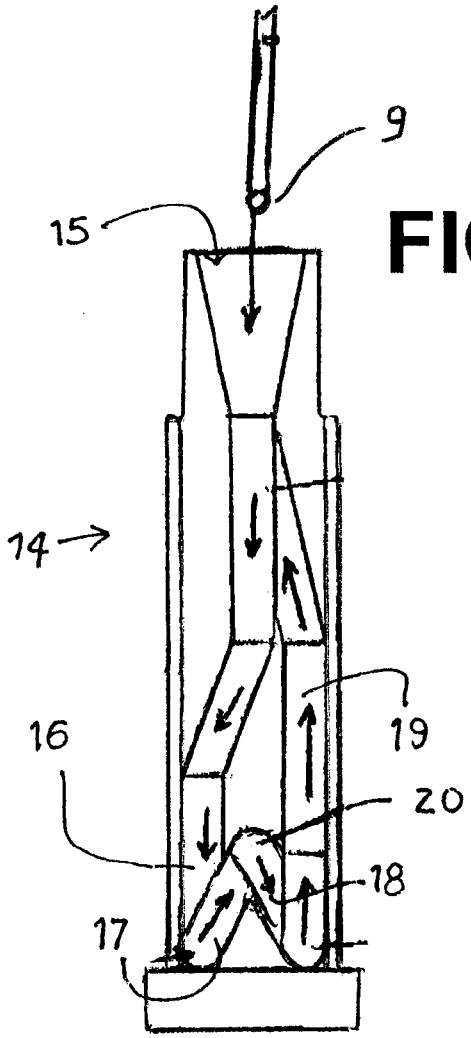
FIG. 3 shows various details for the locking means.

Referring to FIG. 1, the guide portion 5 includes a block 14 having a series of groove-like channels. Referring to FIG. 3, the block 14 has a funnel shaped entrance 15 facing upwards. A first channel 16 proceeds downwards from the entrance to just short of the bottom of the block. The lower end of the first channel terminates just short of a stepped inwards but upwardly angled second channel 17. The second 17 channel terminates just short of a stepped inwards downwardly angled third channel 18, which in turn terminates just short of a stepped inwards upwardly extending fourth channel 19. The upper end of the fourth terminates just short of an upper stepped inwards end of the first channel 16, or alternatively just short of the funnel shaped entrance 15. The channels 16, 17, 18, and 19 together form a pathway, albeit that they may be slightly separated.

When the grapple 1 is in use the sleeve 7 can be pushed downwards by hand so that it moves further down around the shaft 12. This causes the rider 9 to move through the funnel shaped entrance 15 and downwards along the first channel 16 to the end thereof. A slight upward pull on the sleeve 7 results in the rider 9 stepping from the first channel 16 inwards into the second channel 17 such that the rider moves upwards and steps inwards into an upper end of the third channel 18—ie at the point shown in FIG. 3 by reference number 20. With the rider 9 lodged in this position the jaws 2 and 3 are locked open and are thus unable to close on one another. This enables the jaws to be conveniently positioned around a load to be lifted. Subsequently pushing down on the sleeve 7 by hand causes the rider 9 to move down along the third channel, and to step inwards into the fourth channel 19. The sleeve 7 is then free to be pulled upwards, drawing the rider 9 along the fourth channel 19, and up through the entrance 15. The movement of the rider 9 away from the point thus serves to unlock the jaws 2 and 3 so that they are free to move in a clamping action towards one another. This clamping action is of-course needed to move the load.

As will be appreciated, the spring tension in the catch rod 8 assists in keeping the rider 9 within the channels 16, 17, 18 and 19 as the jaws 2 and 3 are locked and unlocked.

Preferably, the grapple 1 is mainly formed from a suitable metallic substance or substances. It should of-course be appreciated that the invention is not limited to only grapple type clamps, but can also include locking clamps of other varieties.

While some preferred aspects of the invention have been described by way of example, it should be appreciated that improvements and modifications can occur without departing from the scope of the appended claims.

What is claimed is:

1. A clamp, comprising a sleeve, a shaft, a pair of jaws, a rod, a long line attachment, a first channel, a second channel, a third channel, and a fourth channel;

A first end of the sleeve being combined with the long line attachment, and a second end of the sleeve receiving the shaft, the sleeve being moveable longitudinally with respect to the shaft, the rod having an angled rider part arranged such that when the sleeve is moved downwards with respect to the shaft the rider can be received in and move along the first channel, at an angle to the first channel into the second channel, and then to the third channel, and will remain at a locked position in the third channel until forcibly moved along the third channel, and then at an angle into the fourth channel to unlock the jaws so that they can move towards one another in a clamping action.

2. A clamp according to claim 1, wherein the rod is spring tensioned.

3. A clamp according to claim 1, wherein the second and third channels are angled with respect to one another.

4. A clamp according to claim 1, wherein the first, second, third, and fourth channels are in a block associated with the shaft, and each channel is at a different level in the block.

5. A clamp according to claim 1, wherein the sleeve is connected to the jaws by way of a chain or cord.

* * * * *